US010181318B2

(12) United States Patent
Hayasaka

(10) Patent No.: US 10,181,318 B2
(45) Date of Patent: Jan. 15, 2019

(54) AUDIO DEVICE AND PROGRAM

(71) Applicant: TEAC CORPORATION, Tokyo (JP)

(72) Inventor: Kaname Hayasaka, Tokyo (JP)

(73) Assignee: TEAC Corporation, Tokyo (JP)

( * ) Notice: Subject to any disclaimer, the term of this patent is extended or adjusted under 35 U.S.C. 154(b) by 0 days.

(21) Appl. No.: 15/900,207

(22) Filed: Feb. 20, 2018

(65) Prior Publication Data

US 2018/0336878 A1 Nov. 22, 2018

(30) Foreign Application Priority Data

May 17, 2017 (JP) ..... 2017-098287

(51) Int. Cl.
*G10K 15/12* (2006.01)
*H04R 3/00* (2006.01)

(52) U.S. Cl.
CPC ..... *G10K 15/12* (2013.01); *H04R 3/00* (2013.01)

(58) Field of Classification Search
None
See application file for complete search history.

(56) References Cited

U.S. PATENT DOCUMENTS

2017/0169807 A1* 6/2017 Sato ..... G10H 1/42

FOREIGN PATENT DOCUMENTS

JP 63-6799 Y2 2/1988
JP 10-124081 A 5/1998

* cited by examiner

*Primary Examiner* — Paul Huber
(74) *Attorney, Agent, or Firm* — Seed IP Law Group LLP

(57) ABSTRACT

A device is provided which adds a desired delay (echo) effect while suppressing increase in the cost with a simple structure. A CPU of an audio device activates a plurality of media players A, B, C, . . . for reproducing an audio file. The audio file is reproduced as an original sound by one of the plurality of media players, and a delay sound with respect to the original sound of the audio file is reproduced by another media player, and is added to the original sound.

5 Claims, 4 Drawing Sheets

AUDIO DEVICE AND PROGRAM

CROSS REFERENCE TO RELATED APPLICATION

The disclosure of Japanese Patent Application No. 2017-098287 filed on May 17, 2017, including the specification, claims, drawings, and abstract, is incorporated herein by reference in its entirety.

TECHNICAL FIELD

The present disclosure relates to an audio device and a program.

BACKGROUND

In the related art, there is proposed a delay (echo) adding technique in an audio device.

JP H10-124081 A describes a reverberation adding circuit that can obtain a superior adjustment feeling of reverberation sound and an audio device which uses the reverberation adding circuit, wherein a microphone signal from a microphone is supplied to a mixing unit, a microphone output signal which is output from the mixing unit is supplied to a delay unit to delay the signal, and the delayed signal is supplied to a reverberation sound volume adjuster. A reverberation signal which is obtained by adjusting a signal level of the signal by the adjuster is supplied to the mixing unit and mixed with the microphone signal, to produce a microphone output signal. When the reverberation sound is reduced by the adjuster, a rate of attenuation of the reverberation sound is set large and a duration of the reverberation sound is shortened. When the reverberation sound is increased, the rate of attenuation of the reverberation sound is set small, and the duration of the reverberation is elongated. A superior adjustment feeling of the reverberation sound can thus be obtained.

JP S63-006799 U discloses an echo circuit which uses a signal delay element such as a BBD (Bucket-Brigade Device), wherein an echo circuit is formed in which an input signal which is applied to a signal input terminal is input to the BBD via a first amplifier and a first low-pass filter, a delay signal which is output from the BBD is added to a direct input signal from the signal input terminal via a second low-pass filter, a second amplifier, and a high-pass filter, and a delay signal which is output from the second amplifier is fed back to an input stage of the first amplifier via an attenuator, and a cutoff frequency of the high-pass filter is set changeable, to thereby adjust the reverberation time.

Normally, addition of a delay (echo) effect can be achieved by multiplying a gain to a delayed waveform and applying a mixing process, and a preliminary filter is provided on the feedback loop so that a high range of the delayed sound is attenuated. The digital signal process can be achieved by repeating a recording process of the input digital signal in a delay memory for a period corresponding to a delay time period and a reading process of the signal from the delay memory. Because the delay time is up to a few hundred milliseconds to a few seconds, when the process is to be realized by a DSP (Digital Signal Processor), the delay unit is realized by a ring buffer of an external memory. In this manner, a memory region for storing the delay data, an address management of the delay data, and control of the reading timing of the delay data becomes necessary, which results in complication of the circuit structure. In addition, because the memory used for the delay has a large number of samples, an external memory is in many cases required, which may cause an increase in the cost.

SUMMARY

The present disclosure provides a technique which can add a desired delay (echo) effect while suppressing an increase in the cost with a simple structure.

According to one aspect of the present disclosure, there is provided an audio device comprising: a controller that activates a plurality of player applications for reproducing an audio file, that reproduces the audio file as an original sound by one of the plurality of player applications, that reproduces a delay sound with respect to the original sound of the audio file by another player application, and that adds the delay sound to the original sound.

According to another aspect of the present disclosure, the audio device further comprises a setter that sets a parameter of a delay effect, wherein the controller reproduces the delay sound by the other player application with a delay time and an output level according to the parameter which is set by the setter.

According to another aspect of the present disclosure, there is provided a recording medium which stores a program which, when executed, causes a processor of a computer to execute the steps of: activating a plurality of player applications for reproducing an audio file; and reproducing the audio file as an original sound by one of the plurality of player applications, reproducing a delay sound with respect to the original sound of the audio file by another player application, and adding the delay sound to the original sound.

According to the present disclosure, a desired delay (echo) effect can be added while the increase in the cost is suppressed with a simple structure.

BRIEF DESCRIPTION OF DRAWINGS

Embodiment(s) of the present disclosure will be described by reference to the following figures, wherein.

DESCRIPTION OF EMBODIMENTS

<Structure>

An embodiment of the present disclosure will now be described by reference to the drawings, and exemplifying a configuration in which an audio interface device and a computer are connected, various audio signals are captured from the audio interface device and supplied to the computer, and the computer suitably edits the audio signals or the like and records the sound, or outputs to the outside via the Internet (Internet live broadcasting).

Figure 1:
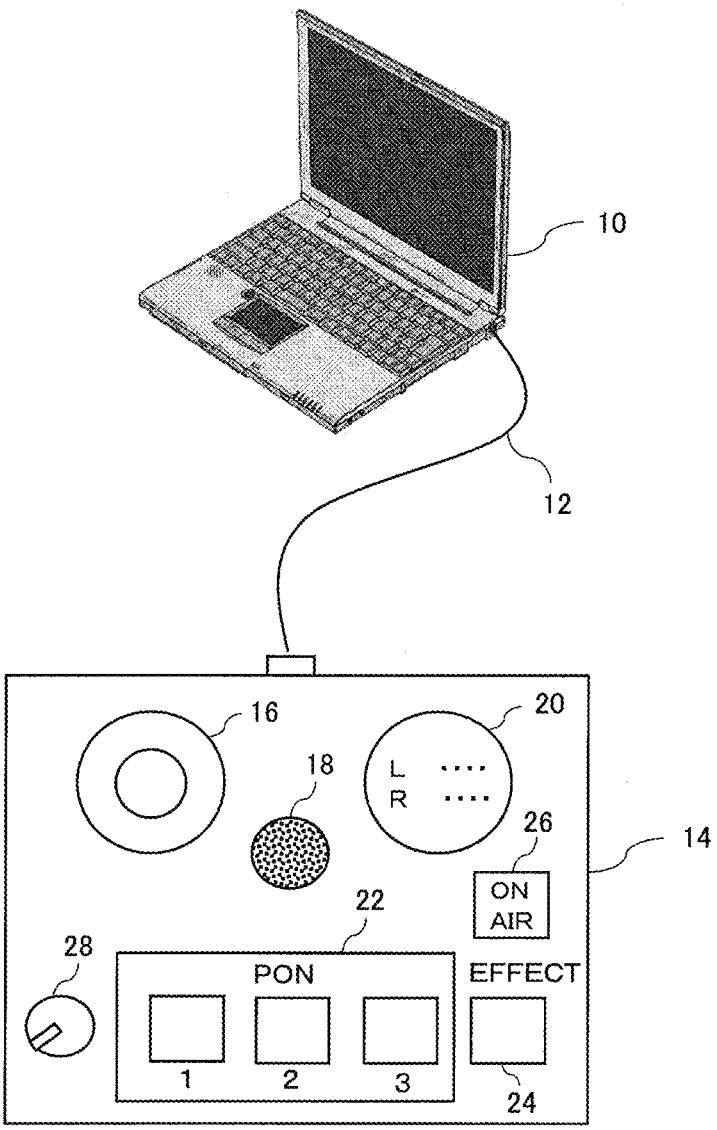
FIG. 1 is a system structural diagram of an embodiment of the present disclosure.

FIG. 1 is a system structural diagram of an embodiment of the present disclosure. An audio system according to the present embodiment comprises a personal computer (PC) 10 and an audio interface device 14. The PC 10 and the audio interface device 14 are connected to each other, for example, by a USB cable 12, in a manner to allow mutual transmission and reception of data.

The PC 10 functions as an audio device according to the present embodiment. In the PC 10, software for inputting, editing, and outputting audio data are installed, and input, output, editing, and reproduction of the audio data are executed using the software.

The audio interface device 14 comprises an amplifier, and analog input terminals and analog output terminals of a plurality of channels, and transmits and receives an audio signal and various control signals to and from the PC 10. The audio interface device 14 comprises a microphone input terminal 16, a built-in microphone 18, a level meter 20, and a headphone output adjustment button 28, and further comprises an immediate output (PON) switch 22 comprising a plurality of buttons, an effect switch 24 which generates various sound effects, and an on-air switch 26.

The immediate output switch 22 comprises three immediate output switches including "immediate output 1," "immediate output 2," and "immediate output 3." When the user presses the immediate output switch 22, the audio interface device 14 supplies a reproduction and output command signal to the PC 10, and the PC 10 reproduces and outputs an audio signal according to the reproduction and output command signal. When the PC 10 is connected to the Internet and the audio signal reproduced by the PC 10 can be output to the outside via the Internet (Internet live broadcasting), with the user operating the immediate output switch 22 while the on-air switch 26 is in an ON state, the audio signal is reproduced and output to the Internet. Desired audio files may be assigned in advance to the three switches of the immediate output switch 22; that is, the "immediate output 1," the "immediate output 2," and the "immediate output 3." The user can press one of the three immediate output switches; that is, the "immediate output 1," the "immediate output 2," and the "immediate output 3," to control the PC 10 to reproduce and output the audio file which is assigned in advance.

The effect switch 24 is a switch for adding a predetermined sound effect to the audio signal. The predetermined sound effect may be arbitrary, and, for example, the process may be a process to add a delay (echo) effect.

The on-air switch 26 is a switch for instructing the PC 10 to output in real time via the Internet. By the user operating the on-air switch 26 to the ON state, for example, it becomes possible to output an audio signal, which is input from the microphone input terminal 16, to the Internet, or to reproduce the audio file assigned in advance to the "immediate output 1" and to output to the Internet by the user operating the "immediate output 1."

Figure 2:
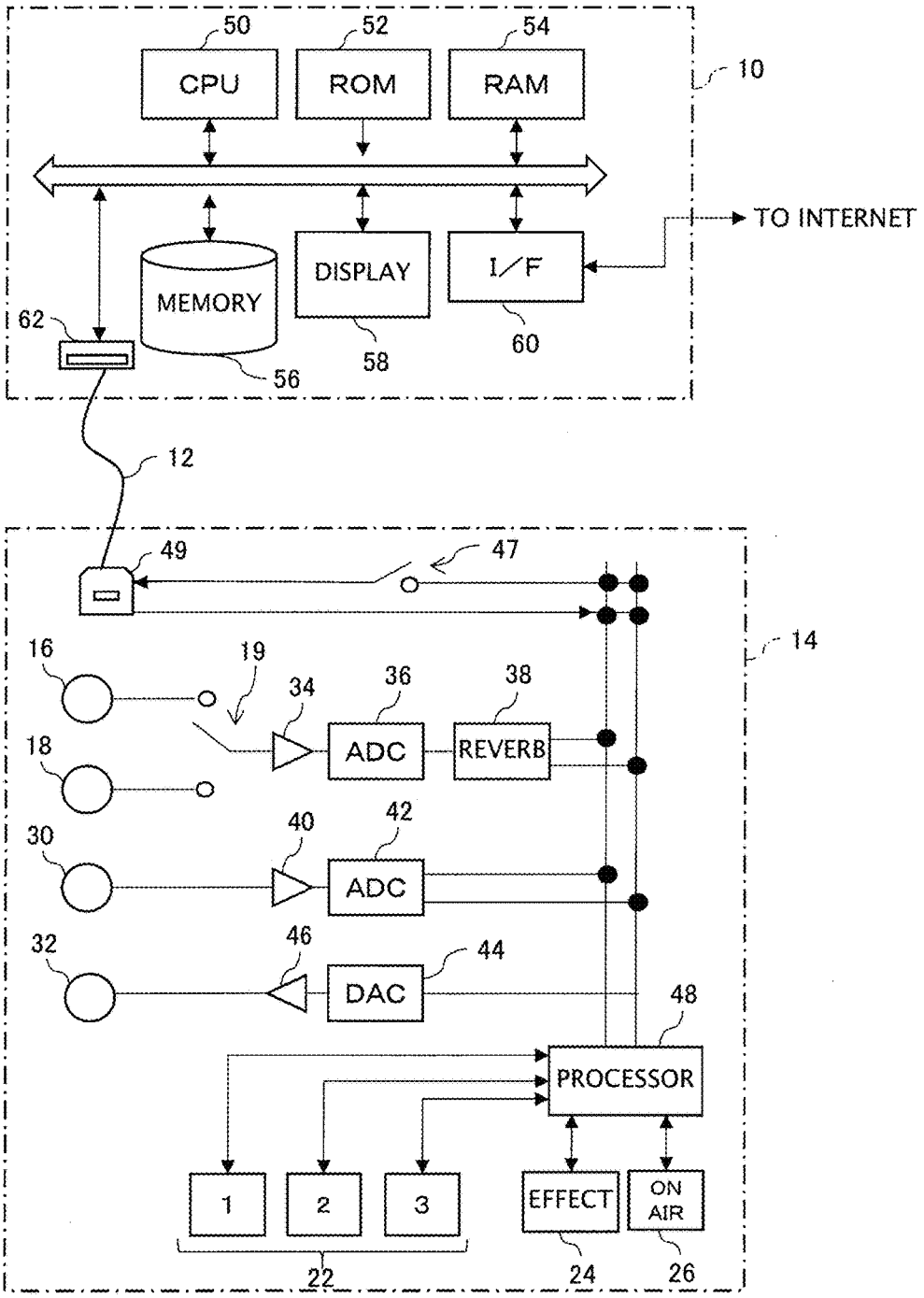
FIG. 2 is a structural block diagram of the embodiment of the present disclosure.

FIG. 2 is a structural block diagram of the system according to the present embodiment.

The PC 10 comprises a CPU 50, a ROM 52, a RAM 54, a memory 56, a display 58, a communication interface I/F 60, and a USB connector 62. In addition to these elements, the PC 10 comprises a known input/output interface such as a mouse, a keyboard, or the like.

One or a plurality of the CPUs 50 read a processing program stored in the ROM 52 or in a hard disk drive, or the like, and realize various functions of the present embodiment by executing the processing program using the RAM 54 as a working memory. In particular, when reproducing the audio file, the CPU 50 activates reproduction software and reproduces the audio file. In reproducing the audio file, the CPU 50 simultaneously activates and controls a plurality of files of the reproduction software to add the delay (echo) effect.

The memory 56 stores the audio file and other files. A format of the audio file is arbitrary, and is, for example, WAV or MP3. The other files are also arbitrary, and may be document data, image data, or video image data.

The display 58 displays various information based on a control command from the CPU 50. For example, the display 58 displays virtual switches corresponding to the switches of the audio interface device 14; more specifically, the immediate output switch 22, the effect switch 24, and the on-air switch 26, to achieve a cooperative operation with the audio interface device 14.

The communication interface I/F 60 is an interface for connecting to the Internet serving as a communication line. The connection with the Internet may be wired or wireless.

The USB connector 62 is a connector for USB-connecting to the audio interface device 14. In the drawings, connection with a USB connector 49 on the side of the audio interface device 14 via the USB cable 12 is schematically shown.

The CPU 50 assigns audio files desired by the user to the three switches of the immediate output switch 22 in advance, according to a user operation. Specifically, the CPU 50 correlates one of the files stored in the memory 56 and one of the switches of the immediate output switch 22 according to the user operation. For example, the CPU 50 correlates an audio file of "AAA.WAV" stored in the memory 56 to the "immediate output 1," and an audio file of "BBB.WAV" to the "immediate output 2." Here, "correlation" specifically refers to a process of registering a path of the audio file to the "immediate output 1." The user may cause, for example, a list of files stored in the memory 56 to be displayed on the display 58, and may assign (correlate) a desired audio file to the immediate output switch by dropping an icon of the desired audio file to the virtual switch corresponding to immediate output switch 22 by a drag-and-drop operation or the like.

The CPU 50 also supplies data showing the assignment state to the USB-connected audio interface device 14. With this process, the assignment state is shared between the PC 10 and the audio interface device 14.

The audio interface device 14 comprises, in addition to the microphone input terminal 16, the built-in microphone 18, the immediate output switch 22, the effect switch 24, and the on-air switch 26 described above, an external input terminal 30, an output terminal 32, selection switches 19 and 47, amplifiers 34, 40, and 46, analog-to-digital converters (ADCs) 36 and 42, a digital-to-analog converter (DAC) 44, and a processor 48.

Audio signals which are input from the microphone input terminal 16 and the built-in microphone 18 are selectively switched by the selection switch 19, and are converted into digital audio signals by the ADC 36 through the amplifier 34. The digital audio signal is output to a stereo bus. An audio signal which is input from the external input terminal (AUX IN) 30 is converted into a digital audio signal by the ADC 42 through the amplifier 40, and is output to the stereo bus.

The audio signals which are input from the microphone input terminal 16, the built-in microphone 18, and the external input terminal 30, or the audio signals which are supplied from the PC 10 are converted into analog audio signals by the DAC 44 through the stereo bus, and are output from the output terminal 32 such as a headphone terminal or the like through the amplifier 46. A gain of the amplifier 46 is adjusted by the headphone output adjustment button 28.

The USB connector 49 for connecting to the PC 10 is connected to the stereo bus through the selection switch 47. The selection switch 47 cooperates with the on-air switch 26. When the on-air switch 26 is operated to the ON state, a connection point is switched ON, and the output of the audio signal from the audio interface device 14 to the PC 10 is started. On the other hand, regardless of the operation of the on-air switch 26, the control signal from the PC 10 to the audio interface device 14 is supplied to the processor 48.

The processor 48 controls operations of various parts of the audio interface device 14. The processor 48 controls the operations according to the operation signals from the immediate output switch 22, the effect switch 24, and the on-air switch 26. Specifically, the processor 48 outputs a reproduction command signal to the PC 10 in response to the operation signal from the immediate output switch 22. When the "immediate output 1" of the immediate output switch 22 is pressed, a reproduction command signal for the "immediate output 1" is output; when the "immediate output 2" is pressed, a reproduction command signal for the "immediate output 2" is output; and when the "immediate output 3" is pressed, a reproduction command signal for the "immediate output 3" is output. The reproduction command signal includes a level signal corresponding to the pressing force when the immediate output switch 22 is pressed. The level signal is a signal which controls the volume when the audio file is reproduced and output. In addition to the volume, the effect or the tune may be controlled according to the pressing force. When the CPU 50 of the PC 10 receives these reproduction command signals, the CPU 50 reproduces the audio file which is assigned to the "immediate output 1," the "immediate output 2," or the "immediate output 3" in advance, and outputs the audio file in a volume level corresponding to the pressing force. Further, the CPU 50 outputs a delay (echo) addition signal in response to the operation signal from the effect switch 24. When the delay (echo) addition signal is received, the CPU 50 of the PC 10 simultaneously controls a plurality of reproduction software, to add the delay (echo) effect. Moreover, the CPU 50 outputs a signal output start (broadcast start) command signal or a signal output stop (broadcast stop) command signal to the PC 10 in response to the operation signal from the on-air switch 26, and controls switching ON and OFF of the selection switch 47.

<Assignment of Audio File>

Figure 3:
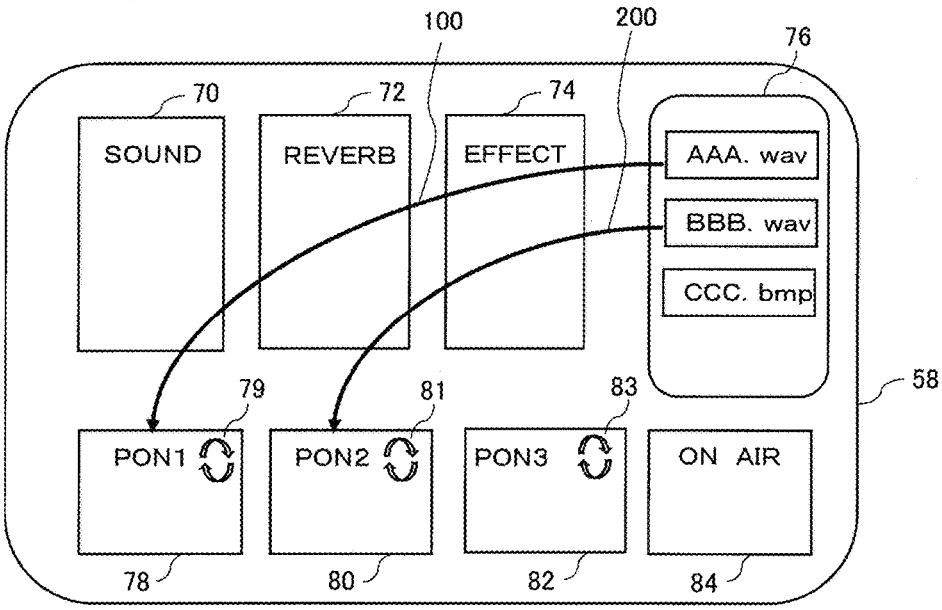
FIG. 3 is an explanatory diagram of assignment of an audio file in the embodiment of the present disclosure.

FIG. 3 is a schematic diagram showing assignment of a desired audio file to the immediate output switch 22 by the user on the PC 10.

The CPU 50 of the PC 10 displays on the display 58 a screen shown in FIG. 3 by executing a processing program. On the setting screen, virtual switches 78, 80, and 82 respectively corresponding to the three switches of the physical immediate output switch 22 of the audio interface device 14; that is, the "immediate output 1," the "immediate output 2," and the "immediate output 3," are displayed, and a virtual switch 84 corresponding to the physical on-air switch 26 of the audio interface device 14 is displayed. Icons 79, 81, and 83 at a top right of the respective virtual switches 78, 80, and 82 are icons for instructing a repeated reproduction of the assigned audio file. Display portions 70, 72, and 74 for displaying the volume (weak talk, strong talk, weak singing, strong singing, or the like), the reverb, and the effect (effects other than reverb) are also displayed. In addition, a list 76 of various files stored in the memory 56 is displayed. The file list 76 may be a list displayed on Explorer of Windows (registered trademark).

The user selects a file to be assigned to the immediate output switch 22 from among the files displayed in the file list 76, and assigns the file to one of the virtual switches 78~82 by a drag-and-drop operation. Alternatively, a configuration may be employed in which, when any of the virtual switches 78~82 is pressed, a file selection screen (such as the file list 76, a tree screen such as Explorer, or the like) is displayed.

For example, when an audio file, "AAA.WAV," is to be assigned to the "immediate output 1," the audio file, "AAA.WAV" is dragged and dropped to the virtual switch 78 corresponding to the "immediate output 1." In the drawings, an arrow 100 represents the drag-and-drop operation of the audio file, "AAA.WAV," to the virtual switch 78. When an audio file, "BBB.WAV," is to be assigned to the "immediate output 2," the audio file, "BBB.WAV," is dragged and dropped to the virtual switch 80 corresponding to the "immediate output 2." In the drawings, an arrow 200 shows the drag-and-drop operation of the audio file, "BBB.WAV," to the virtual switch 80.

When a file is assigned by the drag-and-drop operation, the CPU 50 may judge whether or not the assignment is normal, and may display a result of the judgment on the display 58.

Next, a delay (echo) effect adding process for an audio file executed by one or a plurality of CPUs 50 will be described.

<Delay (Echo) Effect>

Figure 4:
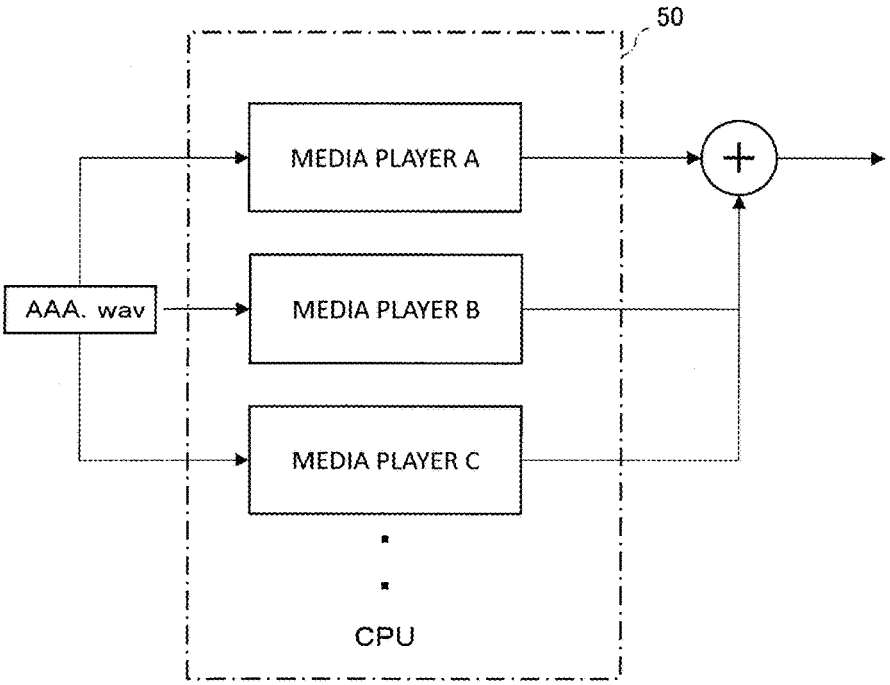
FIG. 4 is an explanatory diagram of execution of a plurality of media players by a CPU.

FIG. 4 schematically shows reproduction software for reproducing an audio file, executed by the CPU 50. One or a plurality of CPUs 50 activate a plurality of reproduction software; more specifically, a media player A, a media player B, a media player C, . . . , when reproducing an audio file (in FIG. 4, "AAA.WAV" is exemplified). All of the media player A, the media player B, the media player C, . . . are software of the same type. In the case of one CPU 50, the media players A, B, C, . . . may be processed in parallel in a time divisional manner, and in the case of a plurality of CPUs 50, the media players A, B, and C may be individually processed by each CPU. The CPU 50 sets, for example, the media player A as a main player, and operates the other media players B, C, . . . as sub players. During reproduction of the audio file, the audio file is reproduced by the media player A, and the media players B, C, . . . reproduce the same audio file with a preset delay time and level, to create a delay (echo) effect. The delay times and levels for the media players B, C, differ from each other. The media players A, B, C, . . . are simultaneously activated, the audio file is reproduced, and the outputs are mixed, so that the delay (echo) effect with a desired delay time and a desired level is added and the resulting signal can be reproduced and output.

Figure 5:
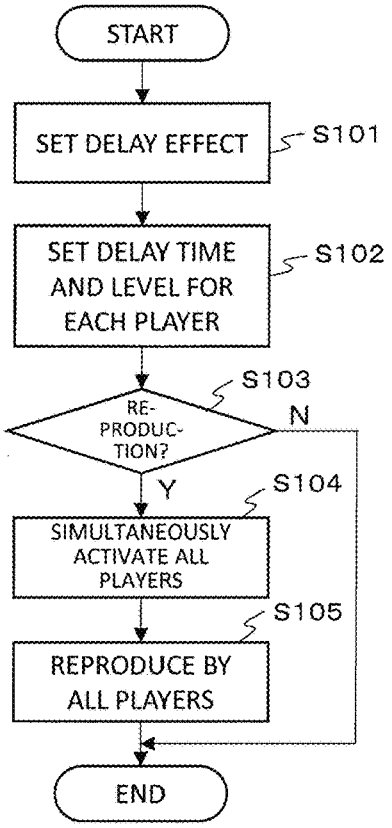
FIG. 5 is a process flowchart in the embodiment of the present disclosure.

FIG. 5 is a flowchart of the delay (echo) effect adding process executed by the CPU 50.

First, the user operates the mouse or the keyboard in a setter; more specifically, a reverb setting window 72 displayed on the display 58 of the PC 10, to set various parameters of the delay (echo) effect (S101). The parameter is, for example, a mode of the delay (echo), which includes HALL mode, ROOM mode, LIVE mode, STUDIO mode, and the like, which are known.

The CPU 50 inputs the set parameter, sets a delay time and an output level for each of the plurality of media players A, B, C, . . . according to the parameters, and stores the same in the memory (S102). For example, when the user selects HALL as the mode, in order to achieve the delay (echo) at HALL: a delay time of 0 and an output level of a are set for the media player A; a delay time of tb and an output level of b are set for the media player B; and a delay time of tc and an output level of c are set for the media player C. The media player A is a media player for reproducing the original sound, and thus, the delay time thereof is 0.

Next, the CPU 50 judges whether or not the user has operated the reproduction button; more specifically, the immediate output switch 22 (S103). When the user presses one of the immediate output switch 22 and the effect switch 24 is pressed and switched ON, the CPU 50 reads from the memory the setting values which are set for the media players in S102, simultaneously activates all media players A, B, C, . . . using the setting values, and reproduces the audio file (S104, S105). Multi-tasking for simultaneously activating a plurality of applications of different types and executing a process is known. However, it should be noted that, unlike the known multi-tasking, in the present embodiment, the CPU 50 automatically activates a plurality of media players of the same type, and, while the original sound is reproduced by one of the media players, delay sounds with respect to the original sound are reproduced by the other media players. The user recognizes that the media player A which is reproducing the original sound is executing the process, but does not necessarily recognize that the other media players B, C, . . . are also executing the process. In this sense, the media players B, C, . . . may be considered to be executing the process in the background.

The CPU 50 may determine in advance the number of media players to be simultaneously activated, or may adaptively adjust (increase or reduce) the number of media players necessary for realizing the delay (echo) effect according to the parameters of the delay (echo) effect which are set in S101. For example, three media players may be used for a certain delay (echo) effect, while six media players may be used for another delay (echo) effect.

For example, six media players A F may be activated and controlled such that: the media player A reproduces a sound which directly reaches the sense of hearing from the original sound; the media player B simulates reproduction of the sound in which the original sound is reflected by a right wall and reaches the sense of hearing; the media player C simulates reproduction of the sound in which the original sound is reflected by a left wall and reaches the sense of hearing; the media player D simulates reproduction of the sound in which the original sound is reflected by a ceiling and reaches the sense of hearing; the media player E simulates reproduction of the sound in which the original sound is reflected by a floor and reaches the sense of hearing; and the media player F simulates reproduction of the sound in which the original sound is reflected by a certain obstructing object and reaches the sense of hearing. With the simultaneously activation and control of these media players, the delay (echo) effect can be easily obtained. Alternatively, an upper limit for the number of media players to be simultaneously activated may be determined in advance according to processing capabilities of the CPU 50.

Figure 6:
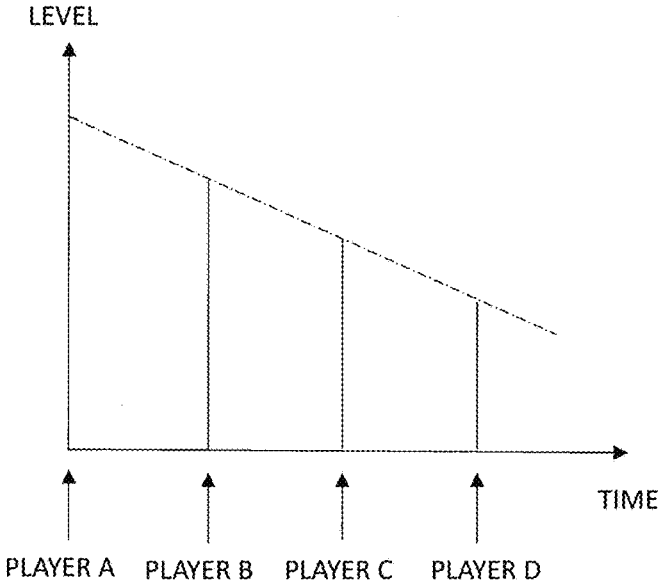
FIG. 6 is an explanatory diagram of a delay (echo) operation.

FIG. 6 schematically shows an adding operation of the delay (echo) effect. In FIG. 6, a horizontal axis represents time (seconds) and a vertical axis represents an output level (dB). The media player A reproduces the audio file as the original sound, the media player B reproduces the audio file after a predetermined delay time, the output level is set to a predetermined level (for example, −4 dB), and the output is added to the original sound. After a further predetermined delay time, the media player C reproduces the audio file, and the output level is set to a predetermined level (for example, −6 dB), and the output is added to the original sound. In this manner, the audio file is reproduced by the plurality of media players, and is output with a predetermined delay time and a predetermined level for each media player, and the outputs are mixed, so that a desired delay (echo) effect can be added with a simple structure, without the need for a memory region for storing the delay data or management of the address for the delay data.

An embodiment of the present disclosure has been described. The present disclosure, however, is not limited to the above-described embodiment, and various modifications may be made. Alternative configurations will now be described.

<Alternatively Configuration 1>

In the embodiment, an audio device is exemplified as the PC 10 connected to the audio interface device 14. The present disclosure is not limited to such a configuration, and can be applied to any arbitrary audio device which reproduces an audio file which is built in or supplied from outside. Further, the "media player" in the embodiment may be any software or program module which can reproduce the audio file, and may reproduce the audio file by calling a sound driver provided by an operating system (OS) of the PC 10.

<Alternative Configuration 2>

In the embodiment, the plurality of media players are activated and controlled by the CPU 50 of the PC 10, but alternatively, the plurality of media players may be activated and controlled by a DSP separate from the CPU 50, to realize the delay (echo) effect.

<Alternative Configuration 3>

In the embodiment, the delay (echo) effect is realized by activating and controlling a plurality of media players by the CPU 50 of the PC 10. In addition, a delay (echo) adding circuit may be provided in the audio interface device 14, to realize the delay (echo) effect as a hardware circuit, or the plurality of media players may be activated and controlled by the processor 48 of the audio interface device 14, to realize the delay (echo) effect. In this case, several configurations may be considered, such as: (1) one of the delay (echo) effect of the audio interface device 14 and the delay (echo) effect of the PC 10 is selected; and (2) both of the delay (echo) effect of the audio interface device 14 and the delay (echo) effect of the PC 10 are used.

In the case of the above-described configuration (1), the user may select one of the effects, or the processor 48 of the audio interface device 14 and the CPU 50 of the PC 10 may communicate with each other, to automatically determine which of the processors is to realize the delay (echo) effect. Normally, the processing capabilities of the processor 48 of the audio interface device 14 are relatively inferior compared to the processing capabilities of the CPU 50 of the PC 10, and thus, in general, it is desirable to realize the delay (echo) effect by the CPU 50 of the PC 10. Even in a case where the delay (echo) effect cannot be added due to insufficiency in the processing capabilities of the processor 48, depending on the audio interface device 14, there may still be cases where the desired delay (echo) effect can be added by the CPU 50 of the PC 10. Alternatively, the process may be adaptively switched according to the mode of the delay (echo) effect.

In the case of the above-described configuration (2), the delay (echo) effect may be primarily added by the audio interface device 14, and the delay (echo) effect may be secondarily (with a higher precision) added by the CPU 50 of the PC 10. Alternatively, a delay (echo) effect that cannot be added by the audio interface device 14 may be supplementarily added by the CPU 50 of the CP 10.

<Alternative Configuration 4>

In the embodiment, as shown by the processing flowchart of FIG. 5, all of the media players are activated for the reproduction when the reproduction operation is executed and the effect switch 24 is in the ON state. Alternatively, when the user has set the effect switch 24 to the OFF state during reproduction of a certain audio file, and then later switches the effect switch ON in the partway of the reproduction, the plurality of media players may be activated for the reproduction at the timing when the user has switched the effect switch 24 ON; that is, when an operation signal for adding the delay (echo) effect is input. Alternatively, with the start of the reproduction, an activation process may be executed for the media player A and the audio file may be reproduced by the media player A, and, for the other audio players, the activation process may be executed and the other audio players may be set to a wait state. Then, immediately after a timing when the operation signal for adding the delay (echo) effect is input, the media players may reproduce the audio file at the delay time and the output level which are set for the media players.

<Alternative Configuration 5>

In the embodiment, a configuration is exemplified in which the audio interface device 14 and the PC 10 are connected, various audio signals are captured from the audio interface device 14 and supplied to the PC 10, and the PC 10 suitably edits the audio signal or the like, for sound recording or output to the outside via the Internet (Internet live broadcasting). The present disclosure, however, is not limited to such a configuration, and may be applied to any audio device that reproduces an audio file while adding the delay (echo) based on a command from the user when reproducing and outputting the audio file. Here, the audio device includes a smartphone and a portable music player.

The invention claimed is:

1. An audio device comprising:

a storage unit that stores a plurality of player applications for reproducing an audio file; and a controller that activates the plurality of player applications, that reproduces the audio file as an original sound by one of the plurality of player applications, that simultaneously reproduces a delay sound with respect to the original sound of the audio file by each of one or more of the player applications other than the one of the plurality of player applications, and that adds the delay sound reproduced by each of the one or more of the player applications to the original sound.

2. The audio device according to claim 1, further comprising:

a setter that sets a parameter of a delay effect for each of the one or more of the player applications, wherein the controller reproduces the delay sound by each of the one or more player applications with a delay time and an output level according to the parameter which is set by the setter for each of the one or more of the player applications.

3. The audio device according to claim 1, wherein the controller simultaneously reproduces the delay sound with respect to the original sound of the audio file by each of two or more of the player applications other than the one of the plurality of player applications, and adds the delay sound reproduced by each of the two or more of the player applications to the original sound.

4. A non-transitory recording medium which stores a program which, when executed, causes a processor of a computer to:

activate a plurality of player applications for reproducing an audio file; and reproduce the audio file as an original sound by one of the plurality of player applications, simultaneously reproduce a delay sound with respect to the original sound of the audio file by each of one or more of the player applications other than the one of the plurality of player applications, and add the delay sound reproduced by each of the one or more of the player applications to the original sound.

5. The recording medium according to claim 4, wherein the program, when executed, causes the processor of the computer to simultaneously reproduce the delay sound with respect to the original sound of the audio file by each of two or more of the player applications other than the one of the plurality of player applications, and add the delay sound reproduced by each of the two or more of the player applications to the original sound.

* * * * *